United States Patent [19]

Broach

[11] 4,363,440

[45] Dec. 14, 1982

[54] COMBUSTION CONTROL SYSTEM

[75] Inventor: George C. Broach, Tulsa, Okla.

[73] Assignee: The G. C. Broach Company, Tulsa, Okla.

[21] Appl. No.: 231,964

[22] Filed: Feb. 6, 1981

Related U.S. Application Data

[63] Continuation-in-part of Ser. No. 40,946, May 21, 1979, abandoned.

[51] Int. Cl.[3] ..... F23N 1/08; F23N 5/00

[52] U.S. Cl. ..... 236/20 R; 236/15 BD; 431/12

[58] Field of Search ..... 236/14, 15 BD, 15 F, 236/20 R; 431/12, 76

[56] References Cited

U.S. PATENT DOCUMENTS

| | | | |
|---|---|---|---|
| 2,163,510 | 6/1939 | Cantrell et al. | 236/15 BD |
| 2,980,334 | 4/1961 | Geniesse | 236/14 |
| 4,003,342 | 1/1977 | Hodgson | 236/14 |

*Primary Examiner*—William E. Wayner
*Attorney, Agent, or Firm*—Robert E. Massa

[57] ABSTRACT

A method and apparatus for controlling combustion in a process heater provides for efficient control of the combustion with a minimum of components. The apparatus includes means for generating a signal from a condition of a process such as temperature, or pressure in the case of a boiler. In one embodiment the milliampere signal is presented in series to a resistor to provide an instant proportional voltage signal. This instant voltage signal is then fed into an R-C network to provide a ramp voltage signal. These two voltages are fed into voltage comparator switches which direct the instant voltage signal and the ramp voltage signal to one of two output amplifiers. The output amplifiers control the output signal to the external control devices. The external control devices adjust the flow of fuel and combustion air. The outputs are controlled so as to always provide a fuel-lean mixture during a change in the operating conditions of the process. As the input signal increases, the instant proportional voltage immediately increases and the ramp voltage signal begins to increase. The voltage comparators switch the instant proportional voltage to the amplifier controlling the combustion air device for an immediate response and the ramp voltage signal is switched to the amplifier controlling the fuel device thus slowly increasing the fuel rate. In the case where the input signal is decreased, the fuel signal is immediately decreased and the air signal is slowly decreased.

3 Claims, 5 Drawing Figures

COMBUSTION CONTROL SYSTEM

BACKGROUND OF THE INVENTION

This application is a continuation-in-part of application Ser. No. 40,946 filed May 21, 1979, now abandoned.

This invention relates broadly to furnaces, boilers, incinerators, and like equipment wherein fuel is burned.

Most particularly, this invention relates to combustion equipment which regulates the flow of combustion air and fuel in response to a signal generated from a condition of a process.

Still more particularly, this invention relates to combustion equipment which will provide a fuel-lean mixture of combustion components as process conditions modify the demand for process heating.

The efficient control of combustion relates to the efficient control of the fuel and combustion oxidant, usually air. Efficient control of combustion is essential in the power industry, chemical industry, and various other process industries.

The amount of heat furnished by the combustion process depends upon the amount of heat needed by the operation requiring the heat, whether for the generation of power, or for the chemical process, or for an oil refinery process. In addition, the amount of heat needed will continually vary, thus requiring continual control of the combustion.

In some industries, particularly the power industry and the chemical industry, the relative efficiency of the combustion process may be accomplished by the use of elaborate control systems, such as computers, various kinds of automatic valves, and electronic controls.

As a result, numerous control systems have been designed to control the combustion processes. And, with time, these systems tend to become more elaborate. Then, as a system becomes more elaborate, the number of components, such as dials, gauges, recorders, computers, and the like, requiring the attention of the operator, increases. With increased complexity, the probability of someone making a mistake increases greatly. The operator has an increased number of recording devices to observe and maintain, dials to continually observe, and switches to be ready to operate, for example.

SUMMARY OF THE INVENTION

Therefore, the primary object of this invention is to provide a method and apparatus for controlling combustion in a process which is efficient, easy to operate, and economical.

Another object of this invention is to provide a method and apparatus for controlling combustion in a process which will require only a minimum number of control components in order to regulate the combustion effectively.

Still another object of this invention is to provide a method and apparatus for controlling combustion in a process in which fuel and combustion air are easily regulated for more efficient energy consumption.

Still another object of this invention is to provide a method and apparatus for maintaining close control of the combustion in a process.

Another object of this invention is to provide a method and apparatus which can be easily adjusted to regulate a combustion temperature.

Another object of this invention is to provide a method and apparatus for controlling combustion in a process heater in which a combustion temperature may be easily maintained.

Still another object of this invention is to provide a method and apparatus for maintaining close control of the energy consumption in a process heater.

These and other objects of the invention will become apparent from the accompanying description and drawings and attached claims.

This invention describes a greatly simplified and efficient method and apparatus for combustion control by eliminating many sophisticated and highly technical controlling devices commonly shown in other combustion control systems.

By simplifying the combustion control system, this invention reduces the number of control devices which the operator must understand and closely observe. Consequently, the risk of accident caused by inattention of the operator is greatly reduced.

Further, this invention provides for a more efficient combustion control system by assuring a fuel-lean combustion during a change in combustion requirements.

All of these advantages are obtained by the application of very few, and simple, low-cost component.

The method and apparatus of this invention include generating a signal from a condition of a process stream and adapting that signal to actuate various fuel and combustion oxidant control components. The type of signal generated includes an electrical, or electronic, signal. The condition of the process stream from which the signal is generated is preferably a temperature of the process, or the pressure of a boiler.

In one typical application, a temperature-responsive device measures a temperature of the process and emits an electrical signal which may be either an increasing voltage signal or a decreasing voltage signal.

The signal is communicated in parallel to a signal restrictive member, such as a resistance, or, more particularly, such as a variable resistance or potentiometer; to a first electro-responsive device, such as a first electronic relay; and to a second electro-responsive device, such as a second electronic relay.

The first electro-responsive device is adapted to respond to a signal of a first characterization, and the second electro-responsive device is adapted to respond to a signal of a second characterization.

The signal restrictive member is further adaptable to communicate a signal to a signal collecting device, such as a capacitance, and the signal collecting device is adaptable to provide a signal of a first characterization and a signal of a second characterization.

The signal collecting device is adaptable to communicate in parallel with the first electro-responsive device and with the second electro-responsive device. The first signal electro-responsive device is further adaptable to communicate with an air control device which is adaptable to control a flow of combustion air in response to a signal from the first electro-responsive device.

The second electro-responsive device is further adaptable to communicate with a fuel control device which is adaptable to control a flow of fuel in response to a signal from the second electro-responsive device.

The invention teaches a method and apparatus for controlling combustion in which fuel-lean combustion is provided during an interval in which the firing rate is changing. For example, when the process system demands more heat, the flow of combustion air is increased prior to an increase in the flow of fuel, thereby maintaining a fuel-lean mixture during the interval of change. Or, when the process system requires the heat to be reduced, the flow of fuel is decreased prior to a decrease in the flow of combustion air, thereby maintaining a fuel-lean mixture during this interval of change.

In an alternate embodiment of the invention, the signal is communicated to a series resistor and a variable R-C ramping network. Voltage comparators are utilized to compare the instantaneous input signal to the output of the ramp network. These voltage comparators control solid state switches which connect two (2) signals to the appropriate output amplifier. The output amplifiers control the signals to the final AIR/FUEL control devices so that during a signal change there will always be a fuel-lean mixture. When the instantaneous input signal is decreasing, the fuel control signal amplifier receives the instant signal direct with the combustion air control amplifier receiving the ramping signal. When the instantaneous input signal is increasing, the fuel control signal amplifier receives the ramping signal and the combustion air control amplifier receives the instantaneous signal.

DESCRIPTION OF THE PREFERRED EMBODIMENTS

Figure 1:
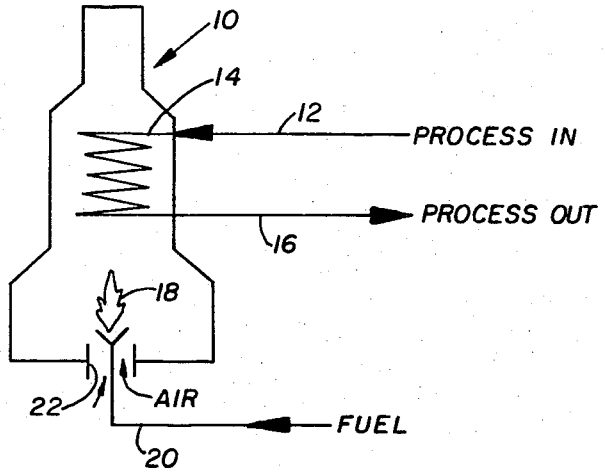
FIG. 1 is a schematic drawing of a typical process heating system.

FIG. 1 describes a typical combustion and heating system for a conventional process industry, which, in its basic arrangement, comprises a furnace or heater 10, generally, having a process inlet stream 12 entering therein, a typical heating coil 14, a process outlet stream 16, and a burner 18 fired by a fuel line 20 and air supplied as through opening 22.

Figure 3:
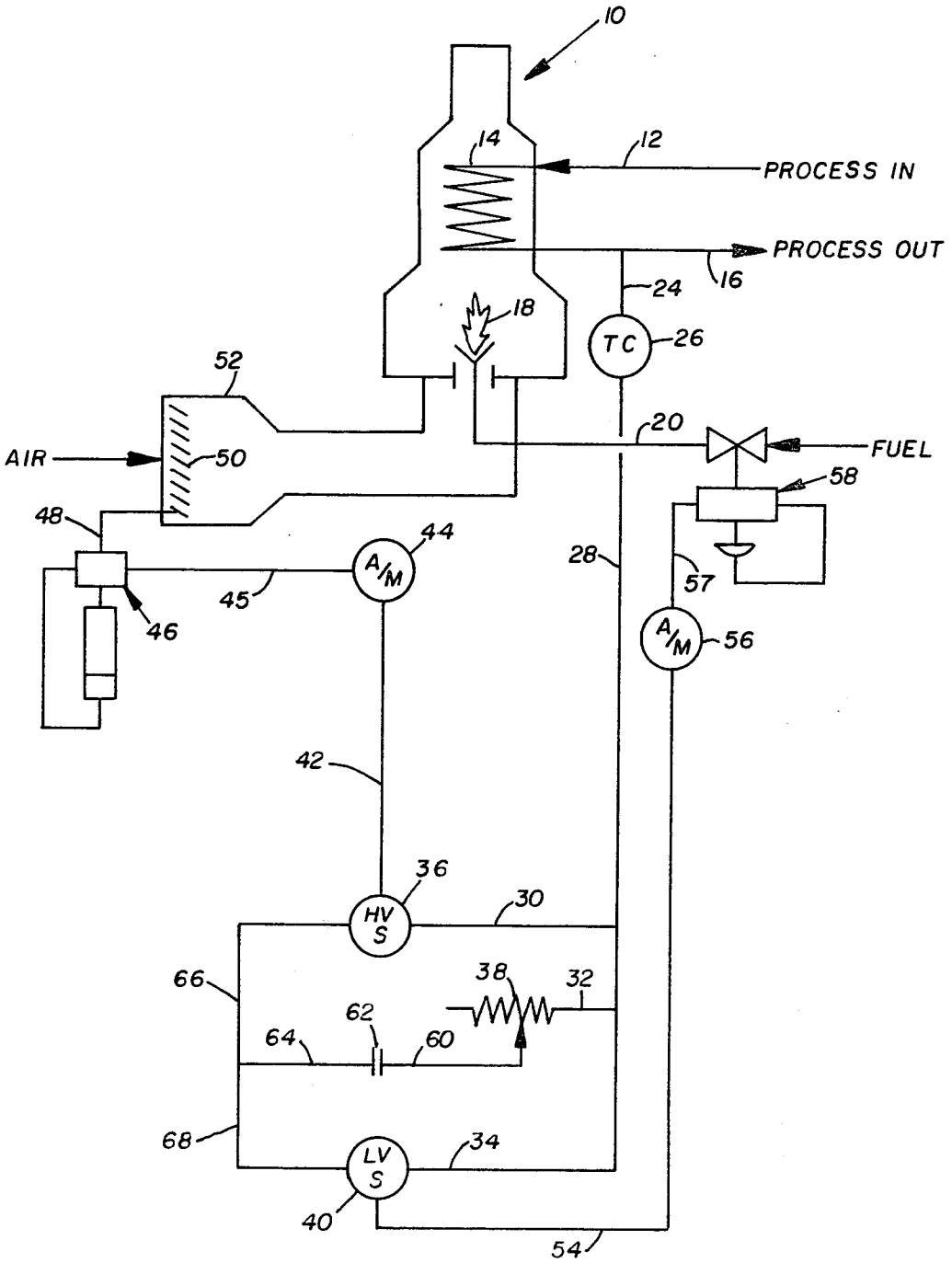
FIG. 3 is a schematic drawing of a combustion control system according to this invention.

In one embodiment of my invention as described in FIG. 3, line 24 provides communication between process outlet stream 16 and a temperature controller 26. Temperature controller 26 may be one of any conventional devices for measuring temperature and providing a signal to other equipment in response to that temperature. Thus, temperature controller 26 measures a temperature of the process stream and provides a signal through lines 28, 30, 32, and 34, in parallel to a first relay 36, a pontentiometer 38, and a second relay 40.

First relay 36 is adapted to respond to an increasing voltage signal in lines 28 and 30. Relay 36 then transmits a signal through line 42 to an air flow control device 44 which, in this embodiment of my invention, further communicates a signal through 45 to an air control device 46, generally, which operates, through connection 48, louvers 50, positioned in air duct 52, to regulate the amount of combustion air.

Second relay 40 is adapted to respond to a decreasing voltage signal in lines 28 and 34. Relay 40 then transmits a signal through line 54 to a fuel control device 56, generally, which further transmits a signal through line 57 to fuel control valve 58, which operates to control the amount of fuel transmitted to burner 18.

Potentiometer 38, is, of course, an adjustable resistance, and, as such, may be adjusted to provide a selected potential through line 60 to condenser 62 which is adapted to transmit a delayed signal through lines 64, 66, and 68, to first relay 36 and second relay 40.

Thus, an increasing potential signal from temperature controller 26 through lines 28 and 32 will cause a delayed potential to develop on condenser 62 and result in a delayed potential drop between relay 36 and condenser 62 and between relay 40 and condenser 62.

The reaction of relay 36 to an increasing potential signal from temperature controller 26 will cause relay 36 to actuate air flow control device 44 and air control device 46 as explained above, assuring a flow of air to burner 18 before a flow of fuel begins.

Relay 40 will not react to the increasing potential through line 34 but will react to the delayed increasing potential through line 68. In response to the increasing potential from condenser 62 to relay 40, relay 40 will actuate fuel control device 56 and fuel control valve 58 to permit a flow of fuel to burner 18 after a flow of air has begun.

A signal of decreasing potential from temperature controller 26 through line 34 will actuate relay 40 to cause relay 40 to actuate fuel control device 56 in a manner to close fuel control valve 58, shutting off the flow of fuel before the flow of air is shut off.

Relay 36 will not react to a signal of decreasing potential from temperature controller 26 through line 30, but will react to a delayed signal of decreasing potential through condenser 62, line 64, and line 66, to actuate air flow control device 44 to operate air control device 46 to shut off the supply of air to burner 18 after the flow of fuel to burner 18 has stopped.

Figure 2:
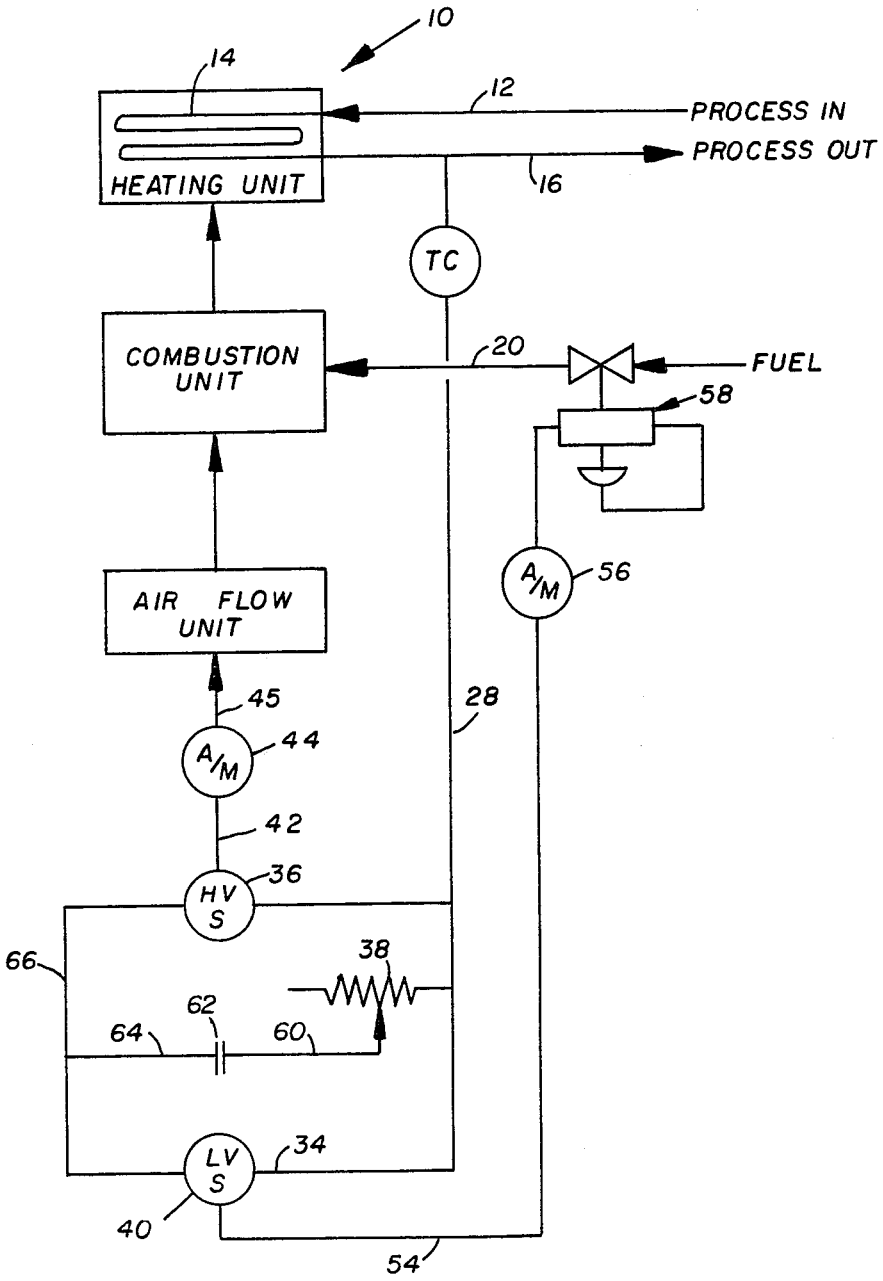
FIG. 2 is a diagrammatic drawing of a combustion control system according to this invention.

FIG. 2 provides a simple outline of a typical process industry embodiment of my invention.

Figure 4:
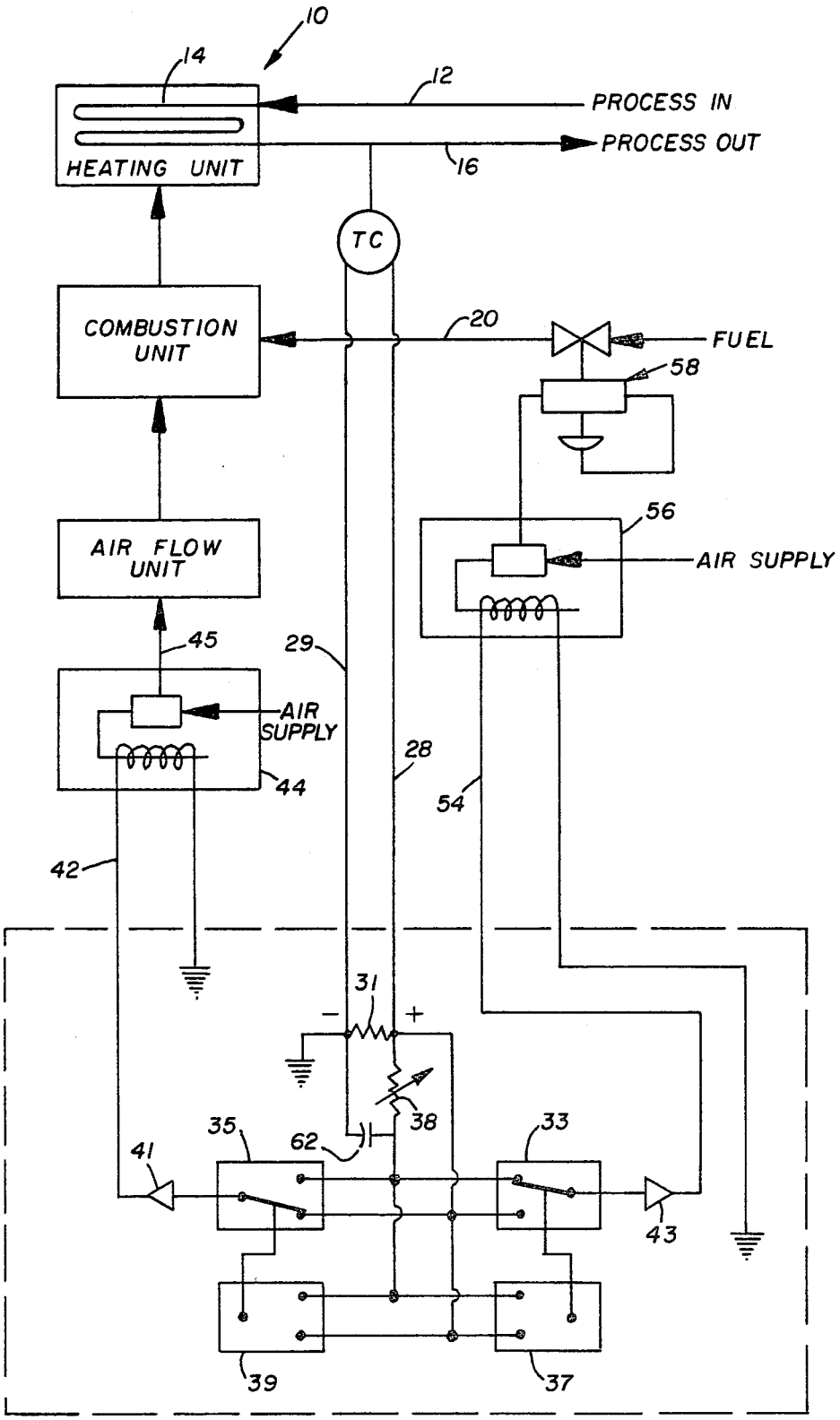
FIG. 4 is a diagrammatic drawing of an alternate embodiment of a combustion control system according to this invention.
Figure 5:
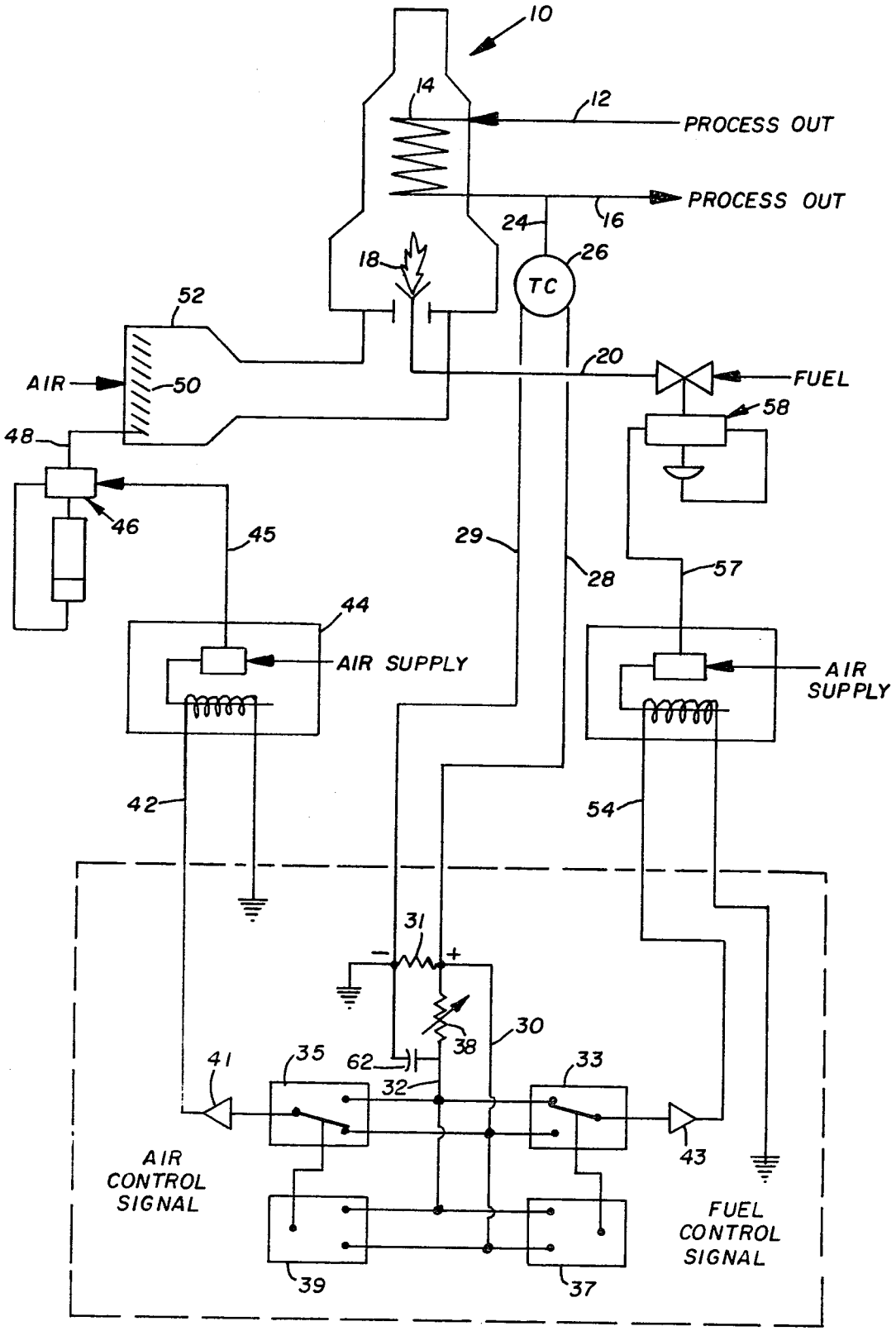
FIG. 5 is a schematic drawing of an alternate embodiment of a combustion control system according to this invention.

In an alternate embodiment of the invention as described above and in FIGS. 4 and 5, temperature controller 26 measures a temperature of the process stream and provides a milliampere signal through lines 28 and 29 and resistor 31. Potentiometer 38 and capacitor 62 form a ramp signal. Switches 33 and 35 and voltage comparators 37 and 39 receive an instantaneous signal through line 30 and a ramp signal through line 32. An output amplifier 41 is connected between switch 35 and air flow control device 44, and an output amplifier 43 is connected between switch 33 and fuel control device 56.

Voltage comparator 39 is set to switch line 30 to amplifier 41 through switch 35 when the signal on line 30 is greater than the signal on line 32. Voltage comparator 39 is set to switch line 32 through switch 35 to amplifier 41 when the signal on line 32 is greater than line 30. Amplifier 41 transmits a signal through 42 to air flow control device 44 as exemplified by current converter 44 which further communicates a signal through 45 to air control device 46 which operates, through connection 48, louvers 50, positioned in air duct 52 to regulate the amount of combustion air.

Voltage comparator 37 is set to switch line 30 to amplifier 43 through switch 33 when the signal on line 30 is less than the signal on line 32. Voltage comparator 37 is set to switch line 32 to amplifier 43 through switch 35 when the signal on line 32 is less than the signal on line 30. Amplifier 43 transmits a signal through 54 to fuel control device 56 as exemplified by current converter 56 which further communicates a signal through 57 to fuel control valve 58.

Potentiometer 38 in conjunction with capacitor 62 are used to determine the ramp signal.

A signal increase from the temperature controller 26 through line 28 will create an increase in voltage across resistor 31. This instantaneous voltage is fed to the ramp control 38 and 62 and through line 30 to comparators 37 and 39. The signal on line 30 is greater than on line 32 therefore line 30 is switched to amplifier 41 by comparator 39 and switch 35, the ramp voltage on line 32 is switched to amplifier 43 by comparator 37 and switch 33.

Thus, an increased signal from the temperature controller will cause the air signal to increase immediately with the fuel signal ramping up to its desired point. A decrease in the temperature control signal will cause the opposite to occur, i.e. the fuel signal will drop immediately and the air signal will ramp down to its desired point.

In a typical operation, temperature controller 26 is set at a chosen temperature so that it may emit a signal of increasing potential when the temperature measured is below the set point, and so that it may emit a signal of decreasing potential when the temperature measured is above the set point.

Thus, when the temperature is at the chosen, or set, point, the potential is essentially constant.

In either situation, as outlined above, an increasing potential signal or a decreasing potential signal, the arrangement of the potentiometer and condenser causes a delay in the response of either the first or second electro-responsive relay so that a fuel-lean mixture is maintained during any change in the operating conditions of the process. It is readily seen, however, that opposite responsiveness of the temperature control and fuel and air control devices could be utilized and the same effectiveness of a fuel-lean mixture still maintained, the important responsiveness being a delay in the transmitting of the fuel control signals.

Since many different embodiments of this invention may be made without departing from the spirit and scope thereof, it is to be understood that the specific embodiments described in detail herein are not to be taken in a limiting sense, since the scope of the invention is best defined by the appended claims.

I claim:

1. A combustion control apparatus, comprising:

a signal generating device adaptable to generate a signal from a condition of a process, the signal generating device coupled in parallel to a resistance, a first electro-responsive device, and a second electro-responsive device, the first electro-responsive device adapted to be responsive to a signal of a first characterization, the second electro-responsive device adapted to be responsive to a signal of a second characterization, the resistance coupled to a first plate of a capacitance, the capacitance adaptable to provide a signal of a first characterization and a signal of a second characterization, a second plate of the capacitance coupled in parallel to the first electro-responsive device and to the second electro-responsive device.

the first electro-responsive device being further coupled to an air control device adaptable to control a flow of combustion air in response to a signal from the first electro-responsive device, and the second electro-responsive device being further coupled to a fuel control device adaptable to control a flow of fuel in response to a signal from the second electro-responsive device.

2. A combustion control apparatus as described in claim 1, wherein:

the first electro-responsive device comprises a first voltage comparator switch, and the second electro-responsive device comprises a second voltage comparator switch.

3. A combustion control apparatus as described in claim 2, wherein:

the first electro-responsive device further includes a first signal output amplifier in series between said first voltage comparator switch and the air control device, and the second electro-responsive device further includes a second signal output amplifier in series between said second voltage comparator switch and the fuel control device.

* * * * *